US010984692B2

(12) United States Patent
Song et al.

(10) Patent No.: US 10,984,692 B2
(45) Date of Patent: Apr. 20, 2021

(54) TEST DISPLAY PANEL, DRIVING METHOD THEREOF AND FORMING METHOD THEREOF

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Dexiong Song, Beijing (CN); Zhiyong Yang, Beijing (CN); Shihua Huang, Beijing (CN); Wei He, Beijing (CN); Jing Wang, Beijing (CN); Liwei Huang, Beijing (CN); Xue Jiang, Beijing (CN); Wei Li, Beijing (CN); Chao Fu, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 330 days.

(21) Appl. No.: 16/056,476

(22) Filed: Aug. 6, 2018

(65) Prior Publication Data

US 2019/0088179 A1 Mar. 21, 2019

(30) Foreign Application Priority Data

Sep. 15, 2017 (CN) ..... 201710833947.4

(51) Int. Cl.

| | |
|---|---|
| ***G09G 3/00*** | (2006.01) |
| ***G09G 3/3258*** | (2016.01) |
| ***G09G 3/20*** | (2006.01) |

(52) U.S. Cl.
CPC ..... *G09G 3/006* (2013.01); *G09G 3/2003* (2013.01); *G09G 3/3258* (2013.01);
(Continued)

(58) Field of Classification Search
CPC .... G09G 3/006; G09G 3/2003; G09G 3/3258; G09G 2300/0426; G09G 2300/0452; G09G 2330/12
See application file for complete search history.

(56) References Cited

U.S. PATENT DOCUMENTS 6,937,279 B1 * 8/2005 Kim ..... H04N 5/378 348/308
10,366,643 B2 * 7/2019 Kwak ..... G09G 3/006
(Continued)

FOREIGN PATENT DOCUMENTS

CN 201138366 Y 10/2008
CN 101666931 A 3/2010
(Continued)

OTHER PUBLICATIONS

Second Chinese Office Action and English translation dated Jul. 30, 2020, for corresponding Chinese Application No. 201710833947.4.
(Continued)

*Primary Examiner* — Antonio Xavier
(74) *Attorney, Agent, or Firm* — Kinney & Lange, P.A.

(57) ABSTRACT

A test display panel is configured for application to a lighting test, and includes a plurality of reference voltage input terminals and a plurality of sub-pixels. The reference voltage input terminals are in a one-to-one correspondence to the sub-pixels. The display panel further includes a reference voltage supply circuit and a plurality of reference voltage lines. The sub-pixels include a plurality of first sub-pixels, second sub-pixels, and third sub-pixels having different colors. The reference voltage lines include a first reference
(Continued)

voltage line, a second reference voltage line, and a third reference voltage line, each corresponding to respective sub-pixels. The reference voltage supply circuit is configured to provide reference voltages to the plurality of reference voltage lines in a time division manner. The reference voltage lines are electrically coupled to respective reference voltage input terminals of the sub-pixels.

15 Claims, 5 Drawing Sheets

(52) U.S. Cl.
CPC ..... *G09G 2300/0426* (2013.01); *G09G 2300/0452* (2013.01); *G09G 2330/12* (2013.01)

(56) References Cited

U.S. PATENT DOCUMENTS

| | | | | |
|---|---|---|---|---|
| 10,366,644 | B2 * | 7/2019 | Kwon | H01L 27/124 |
| 10,395,594 | B1 * | 8/2019 | Charisoulis | G09G 3/3241 |
| 2005/0253942 | A1 * | 11/2005 | Muramatsu | H04N 9/083 348/273 |
| 2006/0279322 | A1 | 12/2006 | Lai | |
| 2010/0060600 | A1 | 3/2010 | Wang et al. | |
| 2015/0001504 | A1 | 1/2015 | Kim et al. | |
| 2015/0062192 | A1 * | 3/2015 | Kim | G09G 3/3291 345/690 |
| 2017/0132965 | A1 | 5/2017 | Hsu | |
| 2017/0154579 | A1 | 6/2017 | Choi et al. | |

FOREIGN PATENT DOCUMENTS

| | | | |
|---|---|---|---|
| CN | 103681692 | A | 3/2014 |
| CN | 104252836 | A | 12/2014 |
| CN | 104392685 | A | 3/2015 |
| CN | 104835451 | A | 8/2015 |
| CN | 105427775 | A | 3/2016 |
| CN | 105652482 | A | 6/2016 |
| CN | 106816135 | A | 6/2017 |
| KR | 20170038345 | A | 4/2017 |
| TW | 200643436 | A | 12/2006 |

OTHER PUBLICATIONS

First Chinese Office Action and English translation dated Feb. 24, 2020, for corresponding Chinese Application No. 201710833947.4.

* cited by examiner

TEST DISPLAY PANEL, DRIVING METHOD THEREOF AND FORMING METHOD THEREOF

CROSS-REFERENCE TO RELATED APPLICATION

The present application claims a priority of the Chinese patent application No. 201710833947.4 filed on Sep. 15, 2017, which is incorporated herein by reference in its entirety.

TECHNICAL FIELD

The present disclosure relates to the field of display technologies, and in particular, to a test display panel, a driving method thereof, and a forming method thereof.

BACKGROUND

Pentile is a way to reduce the number of sub-pixels by sharing sub-pixels by adjacent pixels, so as to achieve high-resolution simulation with low resolution. In the related art, reference voltage input terminals respectively corresponding to all the sub-pixels are coupled to one reference voltage line.

In the Pentile pixel structure, a data voltage is supplied to red sub-pixels R and blue sub-pixels B by the same data line, and then a major RC delay will be caused due to excessive switch impedance in a CELL TEST, whereby a single-color lighting cannot be achieved in the CELL TEST state.

SUMMARY

A test display panel is provided in the present disclosure, applied to a lighting test, including a plurality of reference voltage input terminals and a plurality of sub-pixels, the reference voltage input terminals are in a one-to-one correspondence to the sub-pixels, where the display panel further includes a reference voltage supply circuit and a plurality of reference voltage lines; where the sub-pixels include a plurality of first sub-pixels, second sub-pixels, and third sub-pixels having different colors, the reference voltage lines include a first reference voltage line, a second reference voltage line, and a third reference voltage line, the first reference voltage line corresponds to the plurality of first sub-pixels, the second reference voltage line corresponds to the plurality of second sub-pixels, the third reference voltage line corresponds to the plurality of third sub-pixels; the reference voltage supply circuit is coupled to the plurality of reference voltage lines and configured to provide reference voltages to the plurality of reference voltage lines in a time division manner; the first reference voltage line is electrically coupled to reference voltage input terminals of the first sub-pixels, the second reference voltage line is electrically coupled to reference voltage input terminals of the second sub-pixels, and the third reference voltage line is electrically coupled to reference voltage input terminals of the third sub-pixels.

Optionally, the test display panel further includes a thin film transistor, where the thin film transistor includes a source and a drain arranged in a same layer; the reference voltage input terminals, the plurality of reference voltage lines and the source are arranged in a same layer.

Optionally, the source and the drain are made of a source/drain metal layer; the display panel further includes a conductive layer and an insulating layer arranged between the source/drain metal layer and the conductive layer; the first reference voltage line is electrically coupled to the reference voltage input terminals of at least a part of the first sub-pixels through a first part of first signal lines, the second reference voltage line is electrically coupled to the reference voltage input terminals of at least a part of the second sub-pixels through a second part of the first signal lines, and the third reference voltage line is electrically coupled to the reference voltage input terminals of at least a part of the third sub-pixels through a third part of the first signal lines.

Optionally, the reference voltage input terminals of the first sub-pixels not coupled to the first reference voltage line through the first part of the first signal lines are electrically coupled, through first conductive lines on the conductive layer, to at least one of the reference voltage input terminals electrically coupled to the first part of the first signal lines, the reference voltage input terminals of the second sub-pixels not coupled to the second reference voltage line through the second part of the first signal lines are electrically coupled, through second conductive lines on the conductive layer, to at least one of the reference voltage input terminals electrically coupled to the second part of the first signal lines, and the reference voltage input terminals of the third sub-pixels not coupled to the third reference voltage line through the third part of the first signal lines are electrically coupled, through third conductive lines on the conductive layer, to at least one of the reference voltage input terminals electrically coupled to the third part of the first signal lines; the first conductive line, the second conductive line, and the third conductive line corresponding to the sub-pixels having different colors are electrically insulated from each other.

Optionally, first ends of the first conductive lines are electrically coupled, through via-holes penetrating the insulating layer, to the reference voltage input terminals of the first sub-pixels coupled to the first reference voltage line through the first part of the first signal lines, and second ends of the first conductive lines are electrically coupled, through via-holes penetrating the insulating layer, to the reference voltage input terminals of the first sub-pixels not coupled to the first reference voltage line through the first part of the first signal lines; where the test display panel further includes first extending conductive lines, the first extending conductive lines are configured to electrically couple the reference voltage input terminals of two first sub-pixels not coupled to the first reference voltage line through the first part of the first signal lines, a first end of each first extending conductive line is coupled, through a via-hole penetrating the insulating layer, to the reference voltage input terminal of one first sub-pixel not coupled to the first reference voltage line through the first part of the first signal lines, and a second end of each first extending conductive line is coupled, through a via-hole penetrating the insulating layer, to the reference voltage input terminal of the other first sub-pixel not coupled to the first reference voltage line through the first part of the first signal lines.

Optionally, first ends of the second conductive lines are electrically coupled, through via-holes penetrating the insulating layer, to the reference voltage input terminals of the second sub-pixels coupled to the second reference voltage line through the second part of the first signal lines, and second ends of the second conductive lines are electrically coupled, through via-holes penetrating the insulating layer, to the reference voltage input terminals of the second sub-pixels not coupled to the second reference voltage line through the second part of the first signal lines; where the test display panel further includes second extending conductive lines, the second extending conductive lines are configured to electrically couple the reference voltage input terminals of two second sub-pixels not coupled to the second reference voltage line through the second part of the first signal lines, a first end of each second extending conductive line is coupled, through a via-hole penetrating the insulating layer, to the reference voltage input terminal of one second sub-pixel not coupled to the second reference voltage line through the second part of the first signal lines, and a second end of each second extending conductive line is coupled, through a via-hole penetrating the insulating layer, to the reference voltage input terminal of the other second sub-pixel not coupled to the second reference voltage line through the second part of the first signal lines.

Optionally, first ends of the third conductive lines are electrically coupled, through via-holes penetrating the insulating layer, to the reference voltage input terminals of the third sub-pixels coupled to the third reference voltage line through the third part of the first signal lines, and second ends of the third conductive lines are electrically coupled, through via-holes penetrating the insulating layer, to the reference voltage input terminals of the third sub-pixels not coupled to the third reference voltage line through the third part of the first signal lines; where the test display panel further includes third extending conductive lines, the third extending conductive lines are configured to electrically couple the reference voltage input terminals of two third sub-pixels not coupled to the third reference voltage line through the third part of the first signal lines, a first end of each third extending conductive line is coupled, through a via-hole penetrating the insulating layer, to the reference voltage input terminal of one third sub-pixel not coupled to the third reference voltage line through the third part of the first signal lines, and a second end of each third extending conductive line is coupled, through a via-hole penetrating the insulating layer, to the reference voltage input terminal of the other third sub-pixel not coupled to the third reference voltage line through the third part of the first signal lines.

Optionally, the conductive layer includes at least one of a gate metal layer, an anode layer, and a cathode layer.

Optionally, the conductive layer is an anode layer; the anode layer includes a plurality of anodes separated from each other, and the anodes are in a one-to-one correspondence to the sub-pixels; the first conductive lines, the second conductive lines, and the third conductive lines are arranged between adjacent anodes.

Optionally, the sub-pixels include red sub-pixels, green sub-pixels, and blue sub-pixels; the display panel further includes a first data line, a second data line, and a data voltage supply circuit; the first data line is electrically coupled to the red sub-pixels and the blue sub-pixels, and the second data line is electrically coupled to the green sub-pixels; the data voltage supply circuit is configured to provide DC data voltages to the first data line and the second data line respectively.

A method for driving the above test display panel is further provided in the present disclosure, including: at a lighting test stage, providing, by the reference voltage supply circuit, reference voltages to at least three reference voltage lines in a time division manner.

Optionally, the sub-pixels of the display panel include red sub-pixels, green sub-pixels, and blue sub-pixels; the display panel further includes a first data line, a second data line, and a data voltage supply circuit; the first data line is electrically coupled to the red sub-pixels and the blue sub-pixels, and the second data line is electrically coupled to the green sub-pixels; the method further includes: at the lighting test stage, providing, by the data voltage supply circuit, DC data voltages to the first data line and the second data line respectively.

A method for forming the above test display panel is further provided in the present disclosure, including: forming a source/drain metal layer; patterning the source/drain metal layer to form a plurality of reference voltage input terminals, a plurality of reference voltage lines, and first signal lines configured to couple the reference voltage input terminals to the reference voltage lines.

Optionally, prior to the forming the source/drain metal layer, the method further includes: forming a conductive layer, and patterning the conductive layer to form the conductive lines; forming an insulating layer on the conductive layer, forming via-holes penetrating the insulating layer; the forming the source/drain metal layer includes: forming the source/drain metal layer on the insulating layer; patterning the source/drain metal layer to form the plurality of reference voltage input terminals, the plurality of reference voltage lines, the first signal lines and conductive connection lines, where the conductive connection lines are configured to couple, through the via-holes, the reference voltage input terminals and the conductive lines.

Optionally, subsequent to the patterning the source/drain metal layer to form a plurality of reference voltage input terminals, a plurality of reference voltage lines, and first signal lines configured to couple the reference voltage input terminals to the reference voltage lines, the method further includes: the method further includes: forming an insulating layer on the source/drain metal layer, forming via-holes penetrating the insulating layer; forming a conductive layer on the insulating layer, and patterning the conductive layer to form the conductive lines and conductive connection lines, where the conductive connection lines are electrically coupled through the via-holes to the conductive lines and the reference voltage input terminals.

DETAILED DESCRIPTION OF EMBODIMENTS

The technical solutions in the embodiments of the present disclosure will be clearly and completely described below in conjunction with the accompanying drawings in the embodiments of the present disclosure. It is obvious that the described embodiments are a part of the embodiments of the present disclosure, rather than all of the embodiments. All other embodiments obtained by those of ordinary skill in the art based on the embodiments of the present disclosure without creative labor fall within the scope of protection of the present disclosure.

Figure 1:
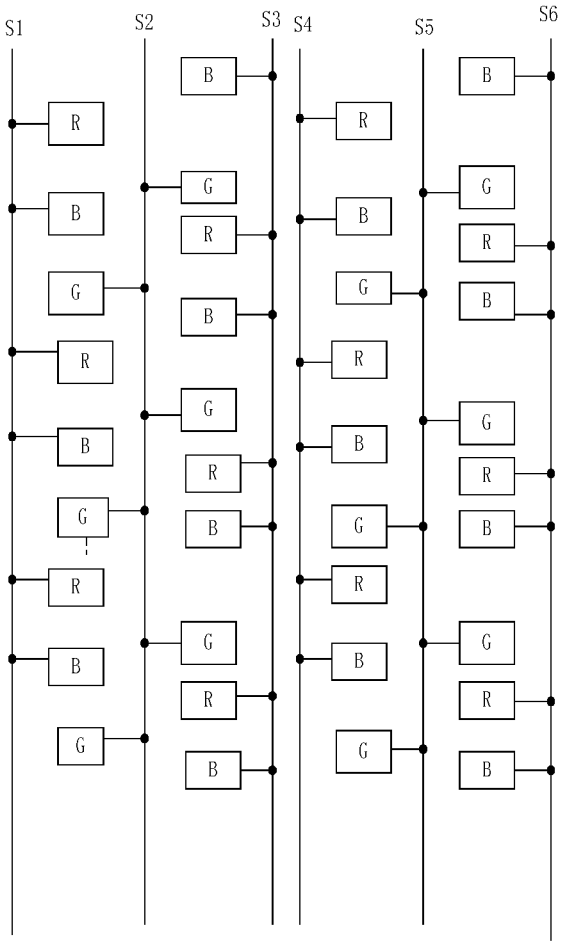
FIG. 1 is a schematic diagram of a pixel structure in the related art.

FIG. 1 is a schematic diagram of a Pentile pixel structure. As shown in FIG. 1, red sub-pixels R and blue sub-pixels B are coupled to the same data line. In FIG. 1, the first column of data lines is denoted by S1, the second column of data lines is denoted by S2, the third column of data lines is denoted by S3, the fourth column of data lines is denoted by S4, the fifth column of data lines is denoted by S5, the sixth column of data lines is denoted by S6, and green sub-pixels are denoted by G. In the related art, the reference voltage input terminals corresponding to all of the sub-pixels are coupled to one reference voltage line (not shown in FIG. 1).

In the Pentile pixel structure, a data voltage is supplied to the red sub-pixels R and the blue sub-pixels B by the same data line, and then a major RC delay will be caused due to excessive switch impedance in a CELL TEST. As a result, the single-color lighting cannot be achieved in the CELL TEST state.

Figure 2:
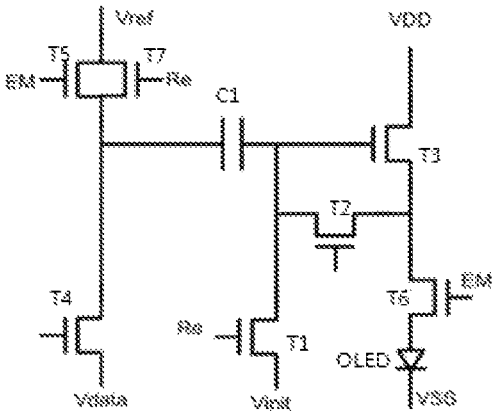
FIG. 2 is a circuit diagram of a sub-pixel circuit in the related art.

FIG. 2 is a circuit diagram of each sub-pixel circuit. As shown in FIG. 2, the sub-pixel circuit of the related art includes a first transistor T1, a second transistor T2, a third transistor T3, a fourth transistor T4, a fifth transistor T5, a sixth transistor T6, a seventh transistor T7, and a storage capacitor C1. In FIG. 2, a light emitting control line is denoted by EM, a reference voltage is denoted by Vref, a data voltage is denoted by Vdata, an initial voltage is denoted by Vinit, an initial control line is denoted by Re, a high power supply voltage is denoted by VDD, a low power supply voltage is denoted by VSS, and an organic light emitting diode is denoted by OLED. In FIG. 2, the current flowing through the OLED is equal to $K\times(Vref-Vdata)^2$, where K is the current coefficient.

The test display panel in some embodiments of the present disclosure is applied to a lighting test, and includes a plurality of reference voltage input terminals, the reference voltage input terminals are in a one-to-one correspondence to the sub-pixels. The display panel further includes a reference voltage supply circuit and at least three reference voltage lines corresponding to different colors respectively, each reference voltage line corresponds to sub-pixels having a corresponding color.

The reference voltage supply circuit is coupled to the at least three reference voltage lines, so as to provide reference voltages to the at least three reference voltage lines in a time division manner.

Each reference voltage line is electrically coupled to a reference voltage input terminal of the sub-pixels having a corresponding color.

According to the test display panel in some embodiments of the present disclosure, the test display panel includes at least three reference voltage lines corresponding to different colors respectively and the reference voltage supply circuit, so as to provide a corresponding reference voltage to the reference voltage input terminals of the sub-pixels having a certain color through a reference voltage line corresponding to the color, thereby providing the reference voltages to respective reference voltage input terminals of sub-pixels having different colors in the lighting test stage and realizing the single-color lighting.

A test display panel for a Cell Test is provided in some embodiments of the present disclosure, and it is required to couple the at least three reference voltage lines corresponding to different colors respectively together when mass producing a normally operating display panel.

The following description is made by taking the display panel including three reference voltage lines as an example.

Figure 3:
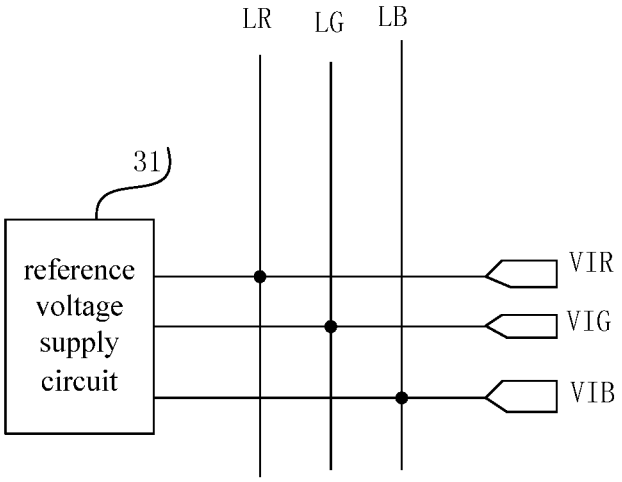
FIG. 3 is a structural diagram of a test display panel in some embodiments of the present disclosure.

As shown in FIG. 3, the test display panel in some embodiments of the present disclosure includes a plurality of reference voltage input terminals, a reference voltage supply circuit 31, and three reference voltage lines corresponding to different colors respectively.

The three reference voltage lines are respectively a red reference voltage line LR, a green reference voltage line LG, and a blue reference voltage line LB. The reference voltage input terminals are in a one-to-one correspondence to the sub-pixels.

The reference voltage supply circuit 31 is coupled to the red reference voltage line LR, the green reference voltage line LG, and the blue reference voltage line LB, to provide corresponding reference voltages in a time division manner to the red reference voltage line LR, the green reference voltage line LG and the blue reference voltage line LB.

The reference voltage supply circuit 31 applies a red reference voltage Vref_R to the red reference voltage line LR; the red reference voltage line LR is electrically coupled to a first reference voltage input terminal VIR of the red sub-pixel.

The reference voltage supply circuit 31 applies a green reference voltage Vref_G to the green reference voltage line LG; the green reference voltage line LG is electrically coupled to a second reference voltage input terminal VIG of the green sub-pixel.

The reference voltage supply circuit 31 applies a blue reference voltage Vref_B to the blue reference voltage line LB; the blue reference voltage line LB is electrically coupled to a third reference voltage input terminal VIB of the blue sub-pixel.

In FIG. 3, only three reference voltage input terminals are schematically illustrated, however in actual operation, the red reference voltage line LR, the green reference voltage line LG, and the blue reference voltage line LB may be respectively electrically coupled to a plurality of corresponding reference voltage input terminals. In actual operation, when the lighting test is performed, respective data lines are applied with respective DC data voltages, and the reference voltage supply circuit 31 applies corresponding reference voltages to the red reference voltage line LR, the green reference voltage line LG, and the blue reference voltage line LB, to control the brightness of all the red sub-pixels, the brightness of all the green sub-pixels, and the brightness of all the blue sub-pixels, respectively, thereby implementing the single-color lighting.

Figure 4:
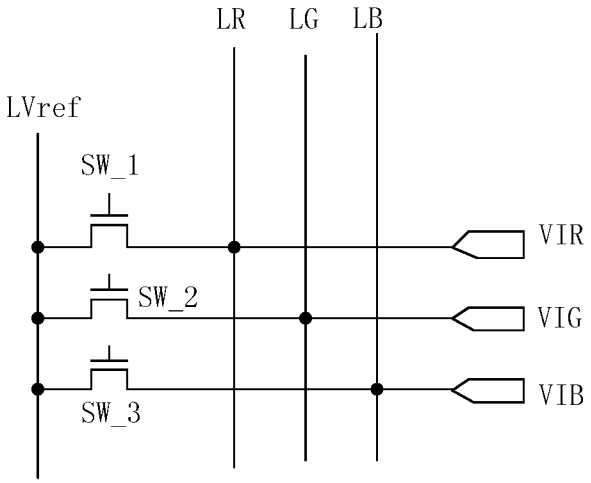
FIG. 4 is a structural diagram of a test display panel in some embodiments of the present disclosure.

Specifically, as shown in FIG. 4, the reference voltage supply circuit may include a first switching switch transistor SW_1, a second switching switch transistor SW_2, a third switching switch transistor SW_3, a total reference voltage line LVref, and a reference voltage supply control circuit (not shown in FIG. 4).

A gate of the first switching transistor SW_1 is coupled to the reference voltage supply circuit, a drain of the first switching transistor SW_1 is coupled to the total reference voltage line LVref, and a source of the first switching transistor SW_1 is coupled to the red reference voltage line LR;

A gate of the second switching transistor SW_2 is coupled to the reference voltage supply circuit, a drain of the second switching transistor SW_2 is coupled to the total reference voltage line LVref, and a source of the second switching transistor SW_2 is coupled to the green reference voltage line LG;

A gate of the third switching transistor SW_3 is coupled to the reference voltage supply circuit, a drain of the third switching transistor SW_3 is coupled to the total reference voltage line LVref, and a source of the third switching transistor SW_2 is coupled to the blue reference voltage line LB;

In some embodiments of the present disclosure, as shown in FIG. 4, the first switching transistor SW_1, the second switching transistor SW_2, and the third switching transistor SW_3 are all n-type transistors, while in actual operation, the above switching transistors may also be p-type transistors, and the type of transistors is not limited herein.

The reference voltage supply control module controls the first switching transistor SW_1, the second switching transistor SW_2, and the third switching transistor SW_3 to be turned on in a time division manner. When the SW_1 is turned on, the reference voltage supply control module outputs a red reference voltage Vref_R to the LVref. When the SW_2 is turned on, the reference voltage supply control module outputs a green reference voltage Vref_B to the LVref. When the SW_3 is turned on, the reference voltage supply control module outputs a blue reference voltage Vref_B to the LVref.

The test display panel in some embodiments of the present disclosure further includes a thin film transistor; the thin film transistor includes a source and a drain which are arranged in the same layer; the reference voltage input terminal and the reference voltage lines and the source are arranged in the same layer. That is, in actual operation, the reference voltage input terminals and the reference voltage lines may be arranged in the same layer.

Specifically, the source and the drain are made of a source/drain metal layer;

The display panel further includes a conductive layer, and an insulating layer arranged between the source/drain metal layer and the conductive layer.

The reference voltage lines are electrically coupled to N reference voltage input terminals of the sub-pixels having the corresponding colors through first signal lines.

There are a plurality of the first signal lines, and the plurality of the first signal lines are arranged in the same layer and insulated from each other.

N is a positive integer, and N is less than the number of reference voltage input terminals of the sub-pixels having a corresponding color and made of the source/drain metal layer;

The reference voltage input terminals of sub-pixels having a certain color not coupled to the reference voltage line corresponding to the certain color respectively through the first signal lines are electrically coupled to, through conductive lines corresponding to the certain color on the conductive layer, at least one of the N reference voltage input terminals.

The conductive lines corresponding to the sub-pixels having different colors are electrically insulated from each other.

In actual operation, each of the reference voltage lines may be directly coupled to several corresponding reference voltage input terminals through a first signal line (the first signal line is made of the source/drain metal layer), and then is electrically coupled to reference voltage input terminals through conductive lines arranged on another conductive layer, thereby avoiding insufficient wiring space on the SD (source/drain metal) layer due to an increase in the number of monochromatic reference voltage lines, and further avoiding short circuits between signal lines.

Figure 5:
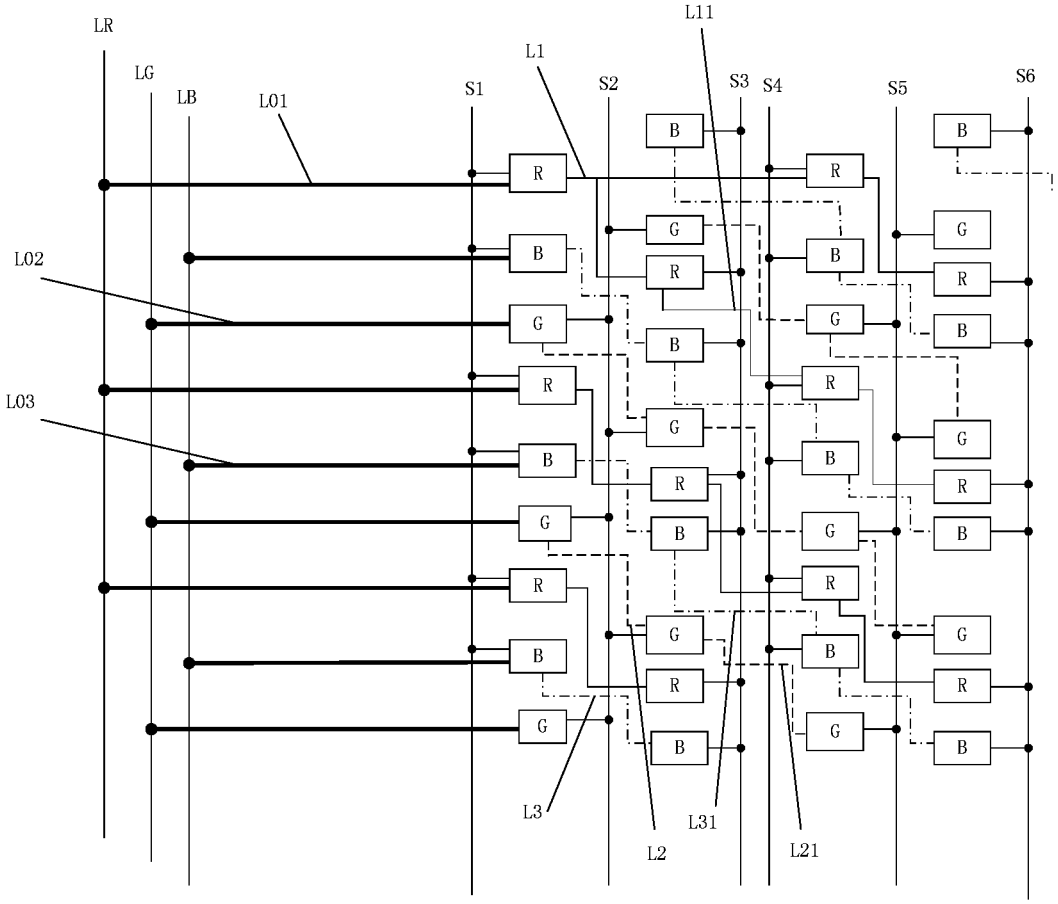
FIG. 5 is a schematic diagram of a connection between reference voltage input terminals and reference voltage lines in a test display panel in some embodiments of the present disclosure.

As shown in FIG. 5, in some embodiments of the present disclosure, the test display panel includes a plurality of reference voltage input terminals and a plurality of sub-pixels, the reference voltage input terminals are in a one-to-one correspondence to the sub-pixels, where the display panel further includes a reference voltage supply circuit and a plurality of reference voltage lines.

The sub-pixels include a plurality of first sub-pixels R, second sub-pixels G, and third sub-pixels B having different colors, the reference voltage lines include a first reference voltage line LR, a second reference voltage line LG, and a third reference voltage line LB. The first reference voltage line LR corresponds to the plurality of first sub-pixels R, the second reference voltage line LG corresponds to the plurality of second sub-pixels G, and the third reference voltage line LB corresponds to the plurality of third sub-pixels B.

The reference voltage supply circuit is coupled to the plurality of reference voltage lines and configured to provide reference voltages to the plurality of reference voltage lines in a time division manner.

The first reference voltage line LR is electrically coupled to reference voltage input terminals of the first sub-pixels R, the second reference voltage line LG is electrically coupled to reference voltage input terminals of the second sub-pixels G, and the third reference voltage line LB is electrically coupled to reference voltage input terminals of the third sub-pixels B.

Optionally, the test display panel further includes a thin film transistor, the thin film transistor includes a source and a drain arranged in a same layer; the reference voltage input terminals, the plurality of reference voltage lines and the source are arranged in a same layer.

Optionally, the source and the drain are made of a source/drain metal layer.

The display panel further includes a conductive layer and an insulating layer arranged between the source/drain metal layer and the conductive layer.

As shown in FIG. 5, the first reference voltage line LR is electrically coupled to the reference voltage input terminals of at least a part of the first sub-pixels R through a first part of first signal lines L01, the second reference voltage line LG is electrically coupled to the reference voltage input terminals of at least a part of the second sub-pixels G through a second part of the first signal lines L02, and the third reference voltage line LB is electrically coupled to the reference voltage input terminals of at least a part of the third sub-pixels B through a third part of the first signal lines L03.

Optionally, as shown in FIG. 5, the reference voltage input terminals of the first sub-pixels R not coupled to the first reference voltage line LR through the first part of the first signal lines L01 are electrically coupled, through first conductive lines L1 on the conductive layer, to at least one of the reference voltage input terminals electrically coupled to the first part of the first signal lines L01. The reference voltage input terminals of the second sub-pixels G not coupled to the second reference voltage line LG through the second part of the first signal lines L02 are electrically coupled, through second conductive lines L2 on the conductive layer, to at least one of the reference voltage input terminals electrically coupled to the second part of the first signal lines L02. The reference voltage input terminals of the third sub-pixels B not coupled to the third reference voltage line LB through the third part of the first signal lines L03 are electrically coupled, through third conductive lines L3 on the conductive layer, to at least one of the reference voltage input terminals electrically coupled to the third part of the first signal lines L03.

The first conductive line L1, the second conductive line L2, and the third conductive line L3 corresponding to the sub-pixels having different colors are electrically insulated from each other.

Optionally, first ends of the first conductive lines L1 are electrically coupled, through via-holes penetrating the insulating layer, to the reference voltage input terminals of the first sub-pixels R coupled to the first reference voltage line LR through the first part of the first signal lines L01. Second ends of the first conductive lines L1 are electrically coupled, through via-holes penetrating the insulating layer, to the reference voltage input terminals of the first sub-pixels G not coupled to the first reference voltage line LG through the first part of the first signal lines L02.

The test display panel further includes first extending conductive lines L11, the first extending conductive lines L11 are configured to electrically couple the reference voltage input terminals of two first sub-pixels R not coupled to the first reference voltage line LR through the first part of the first signal lines L01.

A first end of each first extending conductive line L11 is coupled, through a via-hole penetrating the insulating layer, to the reference voltage input terminal of one first sub-pixel R not coupled to the first reference voltage line LR through the first part of the first signal lines L01, and a second end of each first extending conductive line L11 is coupled, through a via-hole penetrating the insulating layer, to the reference voltage input terminal of the other first sub-pixel R not coupled to the first reference voltage line LR through the first part of the first signal lines L01.

Optionally, first ends of the second conductive lines L2 are electrically coupled, through via-holes penetrating the insulating layer, to the reference voltage input terminals of the second sub-pixels G coupled to the second reference voltage line LG through the second part of the first signal lines L02, and second ends of the second conductive lines L2 are electrically coupled, through via-holes penetrating the insulating layer, to the reference voltage input terminals of the second sub-pixels G not coupled to the second reference voltage line LG through the second part of the first signal lines L02.

The test display panel further includes second extending conductive lines L21, the second extending conductive lines L21 are configured to electrically couple the reference voltage input terminals of two second sub-pixels G not coupled to the second reference voltage line LG through the second part of the first signal lines L02.

A first end of each second extending conductive line L21 is coupled, through a via-hole penetrating the insulating layer, to the reference voltage input terminal of one second sub-pixel G not coupled to the second reference voltage line LG through the second part of the first signal lines L02, and a second end of each second extending conductive line L21 is coupled, through a via-hole penetrating the insulating layer, to the reference voltage input terminal of the other second sub-pixel G not coupled to the second reference voltage line LG through the second part of the first signal lines L02.

Optionally, first ends of the third conductive lines L3 are electrically coupled, through via-holes penetrating the insulating layer, to the reference voltage input terminals of the third sub-pixels B coupled to the third reference voltage line LB through the third part of the first signal lines L03, and second ends of the third conductive lines L3 are electrically coupled, through via-holes penetrating the insulating layer, to the reference voltage input terminals of the third sub-pixels B not coupled to the third reference voltage line LB through the third part of the first signal lines L03.

The test display panel further includes third extending conductive lines L31, the third extending conductive lines L31 are configured to electrically couple the reference voltage input terminals of two third sub-pixels B not coupled to the third reference voltage line LB through the third part of the first signal lines L03.

A first end of each third extending conductive line L31 is coupled, through a via-hole penetrating the insulating layer, to the reference voltage input terminal of one third sub-pixel B not coupled to the third reference voltage line LB through the third part of the first signal lines L03, and a second end of each third extending conductive line L31 is coupled, through a via-hole penetrating the insulating layer, to the reference voltage input terminal of the other third sub-pixel B not coupled to the third reference voltage line LB through the third part of the first signal lines L03.

In some embodiments of the present disclosure, as shown in FIG. 5, the red sub-pixels are denoted by R, the green sub-pixels are denoted by G, and the blue sub-pixels are denoted by B;

The first column of data lines is denoted by S1, the second column of data lines is denoted by S2, the third column of data lines is denoted by S3, the fourth column of data lines is denoted by S4, the fifth column of data lines is denoted by S5, and the sixth column of data lines is denoted by S6.

In FIG. 5, the red reference voltage line LR is directly coupled to the reference voltage input terminals (not shown in FIG. 5) of the red sub-pixels R in the first column through first signal lines L01, the green reference voltage line LG is directly coupled to the reference voltage input terminals (not shown in FIG. 5) of the green sub-pixels G in the first column through first signal lines L02, the blue reference voltage line LB is directly coupled to the reference voltage input terminals (not shown in FIG. 5) of the blue sub-pixels B in the first column through first signal lines L03, and the first signal lines are denoted by bold solid lines.

The red sub-pixels R located in the second, third and fourth column are electrically coupled to the red sub-pixels R located in the first column through the conductive lines denoted by solid lines.

The green sub-pixels G located in the second, third and fourth column are electrically coupled to the green sub-pixels G located in the first column through the conductive lines denoted by dashed lines.

The blue sub-pixels B located in the second, third and fourth column are electrically coupled to the blue sub-pixels B located in the first column through the conductive lines denoted by dot-dash lines.

In actual operation, the data lines may be arranged on the anode layer or the gate metal layer.

In actual operation, the signal lines arranged in the same layer are insulated from each other.

Alternatively, the conductive layer may include at least one of a gate metal layer, an anode layer, and a cathode layer, and may also be other conductive layers.

In some embodiments of the present disclosure, the conductive layer may be an anode layer.

The anode layer includes a plurality of anodes separated from each other, and the anodes are in a one-to-one correspondence to sub-pixels.

The conductive lines are arranged between adjacent anodes.

Specifically, the sub-pixels may include red sub-pixels, green sub-pixels, and blue sub-pixels; the display panel further includes a first data line, a second data line, and a data voltage supply circuit; the first data line is electrically coupled to the red sub-pixels and the blue sub-pixels, and the second data line is electrically coupled to the green sub-pixels.

The data voltage supply circuit is configured to apply corresponding DC data voltages to the first data line and the second data line respectively.

During lighting test, the data voltage supply circuit provides a DC data voltage to the data lines, and corresponding reference voltages are arranged to the sub-pixels having different colors through different monochromatic reference voltage lines, to avoid the difficulty in monochromatic lighting caused by the provision of data voltages to the red sub-pixels and blue sub-pixels by the same data line under the Pentile pixel structure.

Figure 6:
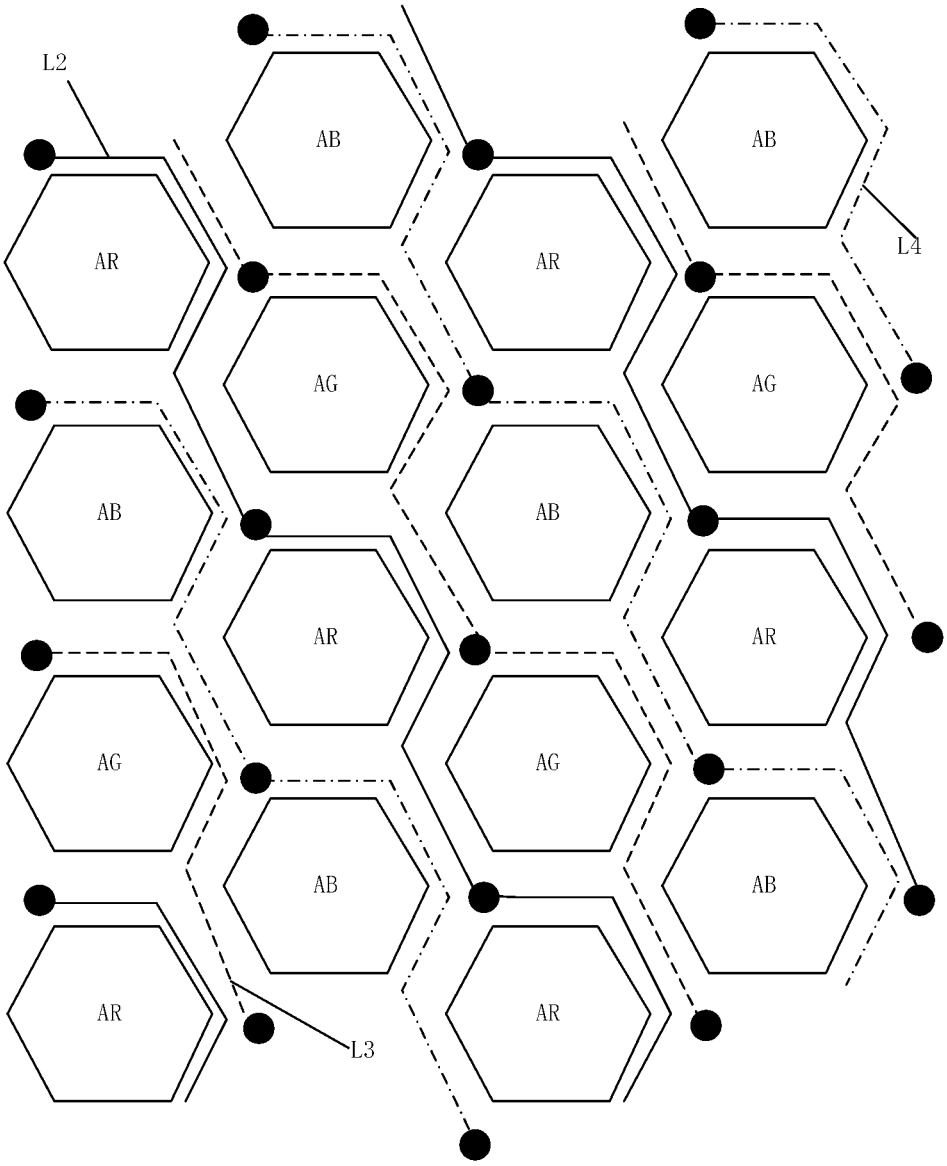
FIG. 6 is a schematic diagram of a via-hole arranged in an anode layer in a test display panel in some embodiments of the present disclosure.

As shown in FIG. 6, when the conductive layer is an anode layer, the anode layer includes a plurality of mutually independent anodes, each of the anodes corresponds to one sub-pixel; in FIG. 6, anodes corresponds to the red sub-pixels are denoted by AR, anodes corresponds to the green sub-pixels are denoted by AG, anodes corresponds to the blue sub-pixels are denoted by AB; in the embodiment shown in FIG. 6, each anode adopts a hexagonal structure, and a black dot is a position at which a via is arranged; solid lines denote red conductive lines L2 between the reference voltage input terminals corresponds to the red sub-pixels, dashed lines denote green conductive lines L3 between the reference voltage input terminals corresponds to the green sub-pixels, dotted lines denote the blue conductive lines L4 between the reference voltage input terminals corresponds to the blue sub-pixels.

In some embodiments of the present disclosure, the SD layer and the anode layer mesh structure region are punctured and overlapped so that the reference voltage is transmitted through two layers, and the SD layer and the anode layer are connected in a punctured manner between adjacent sub-pixels such that the reference voltage is transmitted along monochrome sub-pixels, and may also be transmitted from a near end source of the SD layer (the near end indicates closeness to the reference voltage line) to the anode layer, and then transmitted by the anode layer to a far end (the far end indicates farness from the reference voltage line) to the far end of the SD layer, and then transmitted from the far end of the SD layer to the near end.

Figure 7:
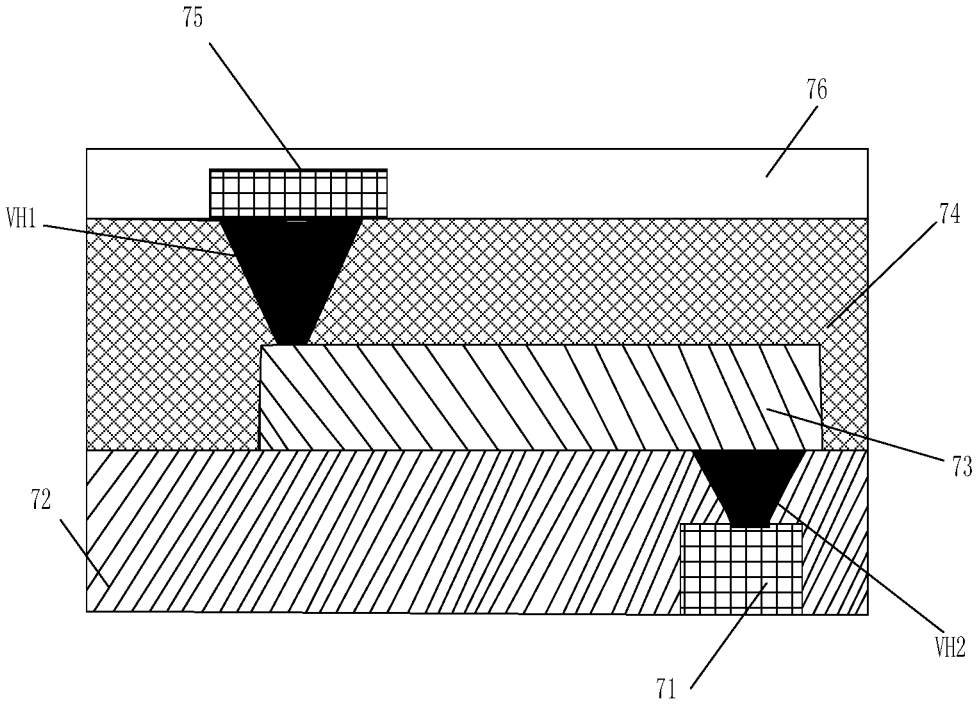
FIG. 7 is a schematic diagram of a test display panel arranged with the via-hole in FIG. 6.

In FIG. 7, an active layer is denoted by 71, an insulating layer is denoted by 72, a source/drain metal layer is denoted by 73, a flat layer is denoted by 74, an anode layer is denoted by 75, a passivation layer is denoted by 76, a first via is denoted by VH1, and a second via is denoted by VH2, wherein the flat layer 74 is an insulating layer arranged between the source/drain metal layer 73 and the anode layer 75.

In actual operation, the anode layer 75 may be made of ITO (Indium Tin Oxide).

A method for driving a test display panel is provided in some embodiments of the present disclosure, applied to drive the above-mentioned test display panel, and the method includes: at a lighting test stage, providing, by the reference voltage supply circuit, reference voltages to at least three reference voltage lines corresponding to different colors respectively in a time division manner.

According to the method for driving the test display panel in some embodiments of the present disclosure, the test display panel includes at least three reference voltage lines corresponding to different colors respectively and the reference voltage supply circuit, so as to provide a corresponding reference voltage to the reference voltage input terminals of the sub-pixels having a certain color through a reference voltage line corresponding to the color, thereby providing the reference voltages to respective reference voltage input terminals of sub-pixels having different colors in the lighting test stage and realizing the single-color lighting.

In some embodiments of the present disclosure, the sub-pixels of the display panel may include red sub-pixels, green sub-pixels, and blue sub-pixels; the display panel further includes a first data line, a second data line, and a data voltage supply circuit; the first data line is electrically coupled to the red sub-pixels and the blue sub-pixels, and the second data line is electrically coupled to the green sub-pixels, the driving method of the display panel includes:

at the lighting test stage, providing, by the data voltage supply circuit, DC data voltages to the first data line and the second data line respectively.

During lighting test, the data voltage supply circuit provides DC data voltages to the data lines, and corresponding reference voltages are arranged to the sub-pixels having different colors through different monochromatic reference voltage lines, to avoid the difficulty in monochromatic lighting caused by the provision of data voltages to the red sub-pixels and blue sub-pixels by the same data line under the Pentile pixel structure.

A method for forming a test display panel is further provided in some embodiments of the present disclosure, applied to form the test display panel as described above, the method for forming a test display panel includes:

forming a source/drain metal layer;

patterning the source/drain metal layer to form a plurality of reference voltage input terminals, at least three reference voltage lines corresponding to the certain color respectively, and first signal lines configured to couple the reference voltage input terminals and the corresponding reference voltage lines, the reference voltage input terminals are in a one-to-one correspondence to the sub-pixels, the reference voltage line corresponding to a certain color corresponds to the sub-pixels having the certain color.

In the case where the pixel density on the display panel is not large, there is no need for two layers of wiring, and all the connection lines between the monochrome reference voltage lines and the corresponding reference voltage input terminals may be arranged on the SD layer (source/drain metal layer); when the pixel density on the display panel is large, it is necessary to adopt the following embodiment in which a part of conductive lines is arranged on another conductive layer.

In some embodiments of the present disclosure, when the conductive layer is arranged under the SD layer (source/drain metal layer), prior to the forming the source/drain metal layer, the method further includes:

forming a conductive layer, and patterning the conductive layer to form the conductive lines;

forming an insulating layer on the conductive layer, forming via-holes penetrating the insulating layer;

the forming the source/drain metal layer includes:

forming the source/drain metal layer on the insulating layer;

patterning the source/drain metal layer to form the plurality of reference voltage input terminals, at least three conductive lines corresponding to different colors respectively, the first signal lines and conductive connection lines, where the conductive connection lines are configured to couple, through the via-holes, the reference voltage input terminals and the conductive lines.

In some embodiments of the present disclosure, when the conductive layer is arranged above the SD layer, subsequent to the patterning the source/drain metal layer to form a plurality of reference voltage input terminals, a plurality of reference voltage lines, and first signal lines configured to couple the reference voltage input terminals to the reference voltage lines, the method further includes: the method further includes:

forming an insulating layer on the source/drain metal layer, forming via-holes penetrating the insulating layer;

forming a conductive layer on the insulating layer, and patterning the conductive layer to form the conductive lines and conductive connection lines, where the conductive connection lines are electrically coupled through the via-holes to the conductive lines and the reference voltage input terminals.

The above are merely exemplary embodiments of the present disclosure. A person skilled in the art may make further modifications and improvements without departing from the principle of the present disclosure, and these modifications and improvements shall also fall within the scope of the present disclosure.

What is claimed is:

1. A test display panel, configured for application to a lighting test, comprising a plurality of reference voltage input terminals and a plurality of sub-pixels, the reference voltage input terminals being in a one-to-one correspondence to the sub-pixels, wherein the display panel further comprises a reference voltage supply circuit and a plurality of reference voltage lines; wherein:

the sub-pixels comprise a plurality of first sub-pixels, second sub-pixels, and third sub-pixels having different colors, the reference voltage lines comprise a first reference voltage line, a second reference voltage line, and a third reference voltage line, the first reference voltage line corresponds to the plurality of first sub-pixels, the second reference voltage line corresponds to the plurality of second sub-pixels, the third reference voltage line corresponds to the plurality of third sub-pixels;

the reference voltage supply circuit is coupled to the plurality of reference voltage lines and configured to provide reference voltages to the plurality of reference voltage lines in a time division manner; and the first reference voltage line is electrically coupled to the reference voltage input terminals of the first sub-pixels, the second reference voltage line is electrically coupled to the reference voltage input terminals of the second sub-pixels, and the third reference voltage line is electrically coupled to the reference voltage input terminals of the third sub-pixels.

2. The test display panel according to claim 1, further comprising a thin film transistor, wherein the thin film transistor comprises a source and a drain arranged in a same layer, and wherein the reference voltage input terminals, the plurality of reference voltage lines and the source are arranged in a same layer.

3. The test display panel according to claim 2, wherein the source and the drain are made of a source/drain metal layer;

the display panel further comprises a conductive layer and an insulating layer arranged between the source/drain metal layer and the conductive layer; and the first reference voltage line is electrically coupled to the reference voltage input terminals of at least a part of the first sub-pixels through a first part of first signal lines, the second reference voltage line is electrically coupled to the reference voltage input terminals of at least a part of the second sub-pixels through a second part of the first signal lines, and the third reference voltage line is electrically coupled to the reference voltage input terminals of at least a part of the third sub-pixels through a third part of the first signal lines.

4. The test display panel according to claim 3, wherein:

the reference voltage input terminals of the first sub-pixels not coupled to the first reference voltage line through the first part of the first signal lines are electrically coupled, through first conductive lines on the conductive layer, to at least one of the reference voltage input terminals electrically coupled to the first part of the first signal lines, the reference voltage input terminals of the second sub-pixels not coupled to the second reference voltage line through the second part of the first signal lines are electrically coupled, through second conductive lines on the conductive layer, to at least one of the reference voltage input terminals electrically coupled to the second part of the first signal lines, and the reference voltage input terminals of the third sub-pixels not coupled to the third reference voltage line through the third part of the first signal lines are electrically coupled, through third conductive lines on the conductive layer, to at least one of the reference voltage input terminals electrically coupled to the third part of the first signal lines; and the first conductive line, the second conductive line, and the third conductive line corresponding to the sub-pixels having different colors are electrically insulated from each other.

5. The test display panel according to claim 4, wherein:

first ends of the first conductive lines are electrically coupled, through via-holes penetrating the insulating layer, to the reference voltage input terminals of the first sub-pixels coupled to the first reference voltage line through the first part of the first signal lines, and second ends of the first conductive lines are electrically coupled, through via-holes penetrating the insulating layer, to the reference voltage input terminals of the first sub-pixels not coupled to the first reference voltage line through the first part of the first signal lines;

the test display panel further comprises first extending conductive lines, the first extending conductive lines being configured to electrically couple the reference voltage input terminals of two first sub-pixels not coupled to the first reference voltage line through the first part of the first signal lines; and a first end of each of the first extending conductive lines is coupled, through a via-hole penetrating the insulating layer, to the reference voltage input terminal of one first sub-pixel not coupled to the first reference voltage line through the first part of the first signal lines, and a second end of each of the first extending conductive lines is coupled, through a via-hole penetrating the insulating layer, to the reference voltage input terminal of the other first sub-pixel not coupled to the first reference voltage line through the first part of the first signal lines.

6. The test display panel according to claim 5, wherein:

first ends of the second conductive lines are electrically coupled, through via-holes penetrating the insulating layer, to the reference voltage input terminals of the second sub-pixels coupled to the second reference voltage line through the second part of the first signal lines, and second ends of the second conductive lines are electrically coupled, through via-holes penetrating the insulating layer, to the reference voltage input terminals of the second sub-pixels not coupled to the second reference voltage line through the second part of the first signal lines;

the test display panel further comprises second extending conductive lines, the second extending conductive lines being configured to electrically couple the reference voltage input terminals of two second sub-pixels not coupled to the second reference voltage line through the second part of the first signal lines; and a first end of each of the second extending conductive lines is coupled, through a via-hole penetrating the insulating layer, to the reference voltage input terminal of one second sub-pixel not coupled to the second reference voltage line through the second part of the first signal lines, and a second end of each of the second extending conductive lines is coupled, through a via-hole penetrating the insulating layer, to the reference voltage input terminal of the other second sub-pixel not coupled to the second reference voltage line through the second part of the first signal lines.

7. The test display panel according to claim 6, wherein:

first ends of the third conductive lines are electrically coupled, through via-holes penetrating the insulating layer, to the reference voltage input terminals of the third sub-pixels coupled to the third reference voltage line through the third part of the first signal lines, and second ends of the third conductive lines are electrically coupled, through via-holes penetrating the insulating layer, to the reference voltage input terminals of the third sub-pixels not coupled to the third reference voltage line through the third part of the first signal lines;

the test display panel further comprises third extending conductive lines, the third extending conductive lines being configured to electrically couple the reference voltage input terminals of two third sub-pixels not coupled to the third reference voltage line through the third part of the first signal lines; and a first end of each of the third extending conductive lines is coupled, through a via-hole penetrating the insulating layer, to the reference voltage input terminal of one third sub-pixel not coupled to the third reference voltage line through the third part of the first signal lines, and a second end of each of the third extending conductive lines is coupled, through a via-hole penetrating the insulating layer, to the reference voltage input terminal of the other third sub-pixel not coupled to the third reference voltage line through the third part of the first signal lines.

8. The test display panel according to claim 3, wherein the conductive layer comprises at least one of a gate metal layer, an anode layer, and a cathode layer.

9. The test display panel according to claim 4, wherein the conductive layer is an anode layer;

the anode layer comprises a plurality of anodes separated from each other, and the anodes are in a one-to-one correspondence to the sub-pixels; and the first conductive lines, the second conductive lines, and the third conductive lines are arranged between adjacent anodes.

10. The test display panel according to claim 1, wherein:

the sub-pixels comprise red sub-pixels, green sub-pixels, and blue sub-pixels;

the display panel further comprises a first data line, a second data line, and a data voltage supply circuit;

the first data line is electrically coupled to the red sub-pixels and the blue sub-pixels, and the second data line is electrically coupled to the green sub-pixels; and the data voltage supply circuit is configured to provide DC data voltages to the first data line and the second data line respectively.

11. A method for driving the test display panel according to claim 1, comprising: at a lighting test stage, providing, by the reference voltage supply circuit, reference voltages to at least three reference voltage lines in a time division manner.

12. The method according to claim 11, wherein the sub-pixels of the display panel comprise red sub-pixels, green sub-pixels, and blue sub-pixels; the display panel further comprises a first data line, a second data line, and a data voltage supply circuit; the first data line is electrically coupled to the red sub-pixels and the blue sub-pixels, and the second data line is electrically coupled to the green sub-pixels; and the method further comprises:

at the lighting test stage, providing, by the data voltage supply circuit, DC data voltages to the first data line and the second data line respectively.

13. A method for forming the test display panel according to claim 1, comprising:

forming a source/drain metal layer; and patterning the source/drain metal layer to form the plurality of reference voltage input terminals, the plurality of reference voltage lines, and first signal lines configured to couple the reference voltage input terminals to the reference voltage lines.

14. The method according to claim 13, wherein prior to the forming the source/drain metal layer, the method further comprises:

forming a conductive layer, and patterning the conductive layer to form the conductive lines; and forming an insulating layer on the conductive layer, forming via-holes penetrating the insulating layer;

and wherein forming the source/drain metal layer comprises:

forming the source/drain metal layer on the insulating layer; and patterning the source/drain metal layer to form the plurality of reference voltage input terminals, the plurality of reference voltage lines, the first signal lines and conductive connection lines, wherein the conductive connection lines are configured to couple, through the via-holes, the reference voltage input terminals and the conductive lines.

15. The method according to claim 13, wherein subsequent to patterning the source/drain metal layer to form the plurality of reference voltage input terminals, the plurality of reference voltage lines, and the first signal lines configured to couple the reference voltage input terminals to the reference voltage lines, the method further comprises:

forming an insulating layer on the source/drain metal layer, and forming via-holes penetrating the insulating layer; and forming a conductive layer on the insulating layer, and patterning the conductive layer to form the conductive lines and conductive connection lines, wherein the conductive connection lines are electrically coupled through the via-holes to the conductive lines and the reference voltage input terminals.

* * * * *